US007913707B2

(12) United States Patent
Lai

(10) Patent No.: US 7,913,707 B2
(45) Date of Patent: Mar. 29, 2011

(54) UMBRELLA HAVING AN ANGLE ADJUSTABLE FUNCTION

(75) Inventor: Jin-Sheng Lai, Taipei (TW)

(73) Assignee: Galtech Computer Corp., Newbury Park, CA (US)

( * ) Notice: Subject to any disclaimer, the term of this patent is extended or adjusted under 35 U.S.C. 154(b) by 7 days.

(21) Appl. No.: 12/498,521

(22) Filed: Jul. 7, 2009

(65) Prior Publication Data

US 2011/0005558 A1 Jan. 13, 2011

(51) Int. Cl.
*A45B 25/02* (2006.01)
*A45B 19/00* (2006.01)

(52) U.S. Cl. ..... 135/21; 135/20.3

(58) Field of Classification Search ..... 135/20.1, 135/20.3, 21, 90, 98, 16; 473/482–484; 211/197; 248/317, 323, 324
See application file for complete search history.

(56) References Cited

U.S. PATENT DOCUMENTS

| | | | | |
|---|---|---|---|---|
| 2,595,697 | A * | 5/1952 | Pereira | 135/20.3 |
| 6,014,980 | A * | 1/2000 | Glatz | 135/20.1 |
| 6,152,156 | A * | 11/2000 | Tung | 135/21 |
| 6,220,261 | B1 * | 4/2001 | Glatz | 135/20.3 |
| 6,435,444 | B1 * | 8/2002 | Lin | 242/396.6 |
| 6,953,043 | B2 * | 10/2005 | Yu | 135/20.1 |
| 7,134,442 | B2 * | 11/2006 | Ma | 135/20.1 |
| 7,493,909 | B2 * | 2/2009 | Ma | 135/20.3 |
| 7,556,051 | B2 * | 7/2009 | Lai | 135/21 |
| 7,708,022 | B2 * | 5/2010 | Joen-an Ma | 135/20.1 |
| 7,717,121 | B2 * | 5/2010 | Glatz | 135/21 |
| 2010/0037929 | A1 * | 2/2010 | Liu | 135/20.3 |

FOREIGN PATENT DOCUMENTS

| | | | |
|---|---|---|---|
| EP | 1550383 | A1 * | 7/2005 |
| JP | 2004194934 | A * | 7/2004 |

* cited by examiner

*Primary Examiner* — Winnie Yip
(74) *Attorney, Agent, or Firm* — Alan Kamrath; Kamrath & Associates PA

(57) ABSTRACT

An umbrella includes an upright post, a swing mechanism mounted on the upright post and a frame mounted on the swing mechanism. The swing mechanism includes a mounting seat mounted on the upright post, a pivot seat pivotally mounted on the mounting seat and having a lower end provided with a worm wheel, a worm rotatably mounted on the mounting seat and meshing with the worm wheel, a driven gear secured on the worm, a propeller shaft rotatably mounted on the upright post, a drive gear secured on the propeller shaft and meshing with the driven gear, and a rocker arm secured on the propeller shaft. Thus, when the swing mechanism is operated, the frame is rolled and tilted relative to the upright post leftward or rightward to adjust the inclined angle the frame to provide a better shading effect.

15 Claims, 12 Drawing Sheets

UMBRELLA HAVING AN ANGLE ADJUSTABLE FUNCTION

BACKGROUND OF THE INVENTION

1. Field of the Invention

The present invention relates to a shading device and, more particularly, to an umbrella or a sunshade to provide a shading function.

2. Description of the Related Art

A conventional umbrella or sunshade comprises an upright post and a frame mounted on the upright post. The frame includes a mounting bracket secured on and supported by the upright post, a support shank extending through the mounting bracket, a skeleton foldably mounted on an upper end of the support shank, a canopy mounted on the skeleton, a grip portion mounted on a lower end of the support shank, and an elbow link having a lower end pivotally connected with the upright post and an upper end pivotally connected with the grip portion. When in use, the canopy mounted on the skeleton can be opened to provide a shading effect to a user and can be closed when not in use. However, the frame is securely mounted on the upright post so that the canopy mounted on the skeleton has a fixed angle that cannot be adjusted according to the present weather condition. Thus, the canopy cannot efficiently shade the user, thereby limiting the shading effect of the umbrella when the sunshine or rain is directed in an oblique angle.

BRIEF SUMMARY OF THE INVENTION

In accordance with the present invention, there is provided an umbrella, comprising an upright post, a swing mechanism pivotally mounted on the upright post and a frame mounted on the swing mechanism to move in concert with the swing mechanism and to pivot relative to the upright post. The swing mechanism includes a mounting seat mounted on an upper end of the upright post, a pivot seat pivotally mounted on the mounting seat and having a lower end provided with a worm wheel, a worm rotatably mounted on the mounting seat and meshing with the worm wheel of the pivot seat to drive the pivot seat to pivot relative to the mounting seat, a driven gear secured on the worm to rotate the worm, a propeller shaft rotatably mounted on the upper end of the upright post, a drive gear secured on the propeller shaft to rotate in concert with the propeller shaft and meshing with the driven gear to rotate the driven gear, and a rocker arm secured on the propeller shaft to rotate the propeller shaft. The swing mechanism further includes a fixing seat secured on a bottom of the mounting seat to support the propeller shaft and to limit the worm and the driven gear, two first bearings mounted between the propeller shaft and the fixing seat and two second bearings mounted between the mounting seat and the worm.

The primary objective of the present invention is to provide an umbrella having an angle adjustable function.

Another objective of the present invention is to provide an umbrella, wherein when the swing mechanism is operated, the frame is rolled relative to the upright post to tilt leftward or rightward to adjust the inclined angle of the skeleton of the frame so as to provide a better shading effect.

A further objective of the present invention is to provide an umbrella, wherein the user only needs to drive the rocker arm to change and adjust the inclined angle of the frame, so that the user can operate the rocker arm to adjust the inclined angle of the frame easily and quickly.

A further objective of the present invention is to provide an umbrella, wherein the swing mechanism has a simplified construction, thereby greatly decreasing the cost of fabrication of the umbrella.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
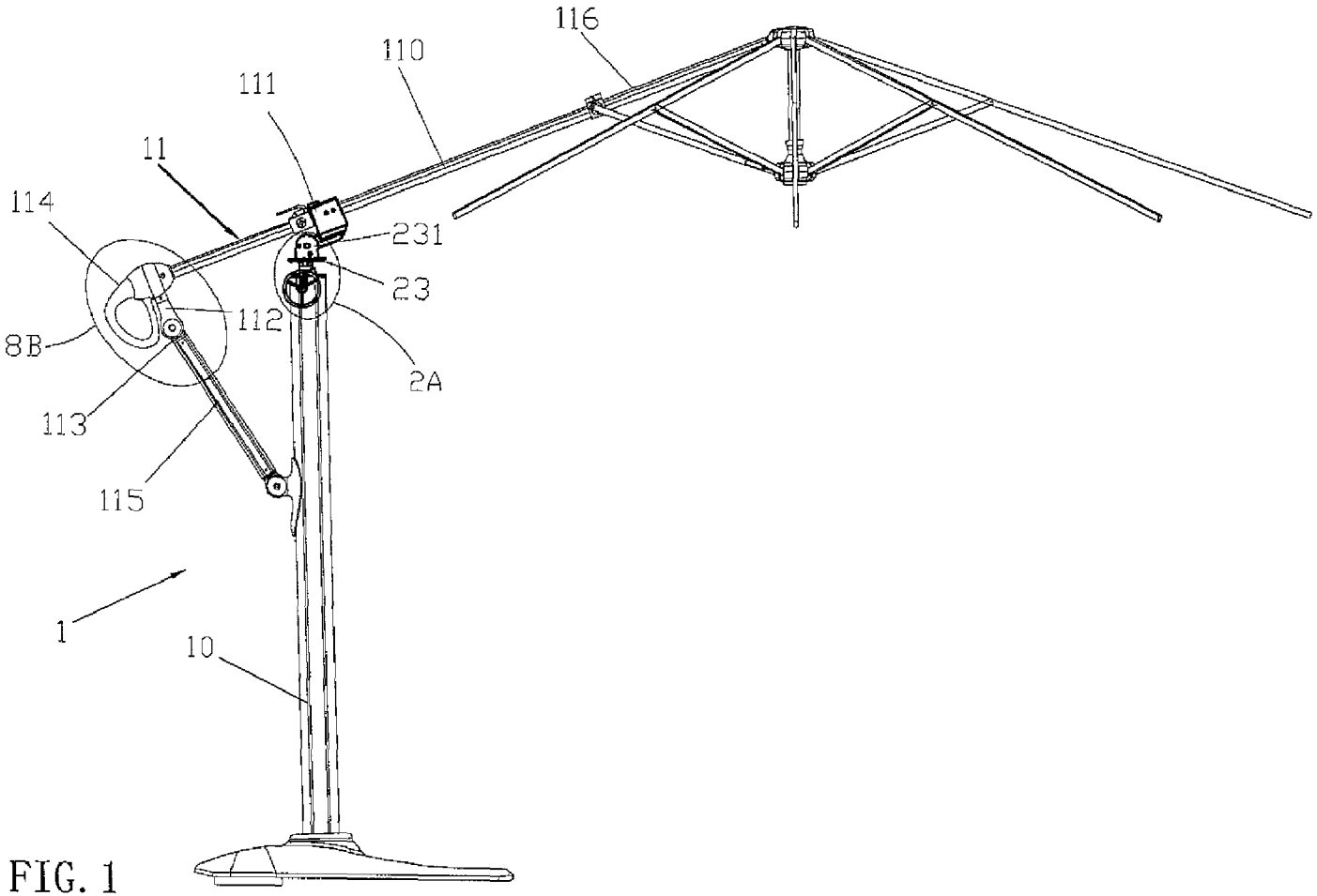
FIG. 1 is a side view of an umbrella in accordance with the preferred embodiment of the present invention.
Figure 2:
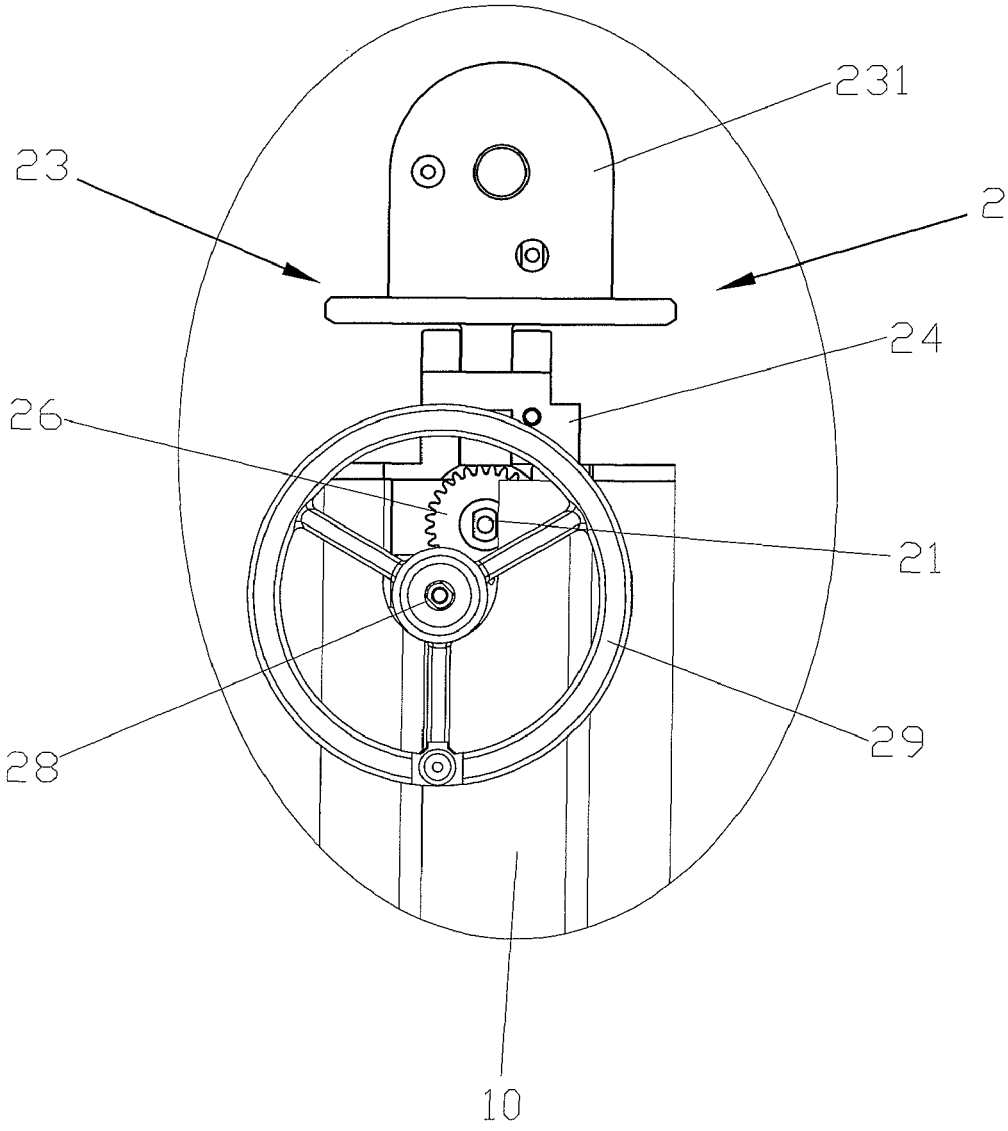
FIG. 2 is a locally enlarged view of the umbrella taken along an oblong mark "2A" as shown in FIG. 1.
Figure 3:
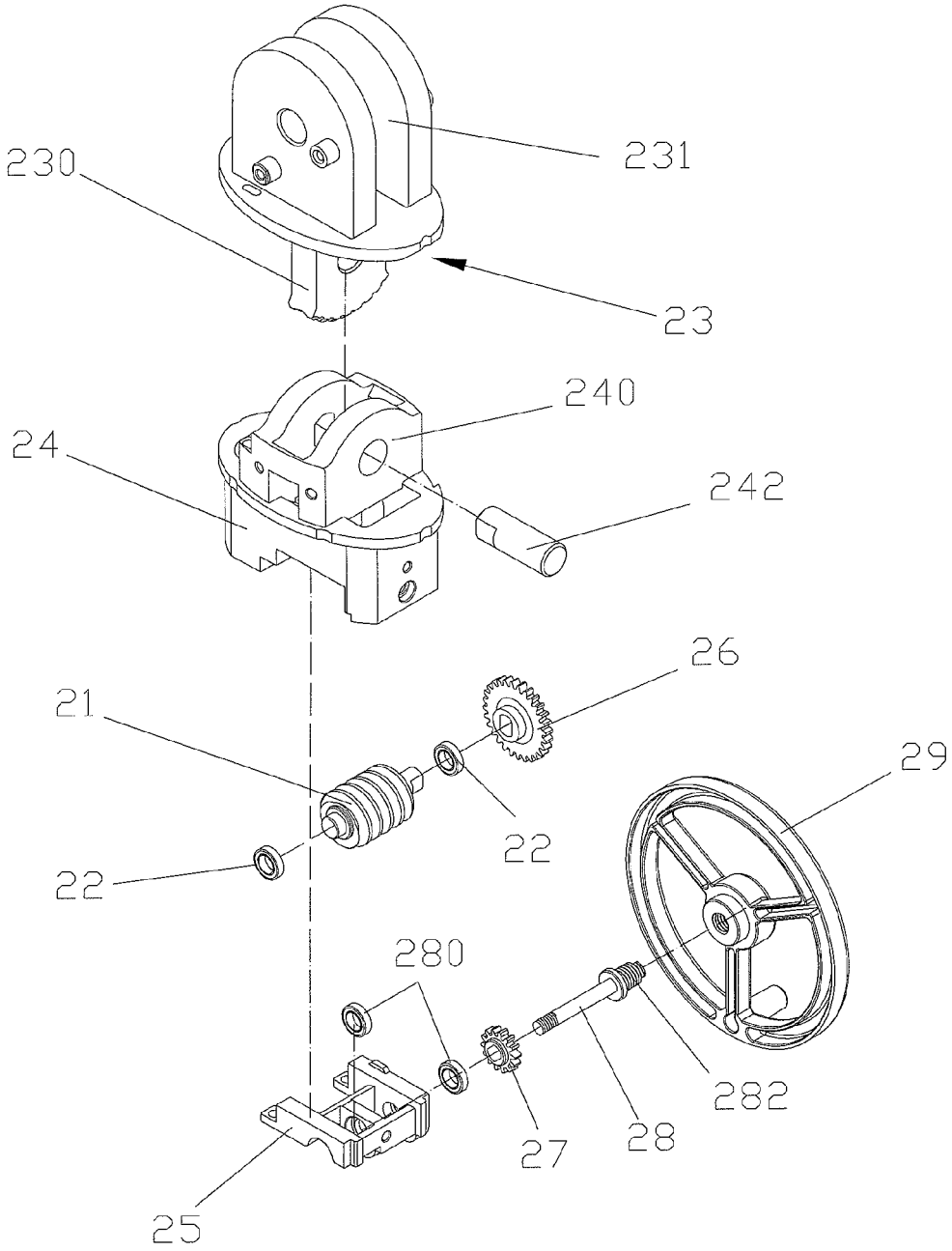
FIG. 3 is an exploded perspective view of a swing mechanism of the umbrella as shown in FIG. 1.
Figure 4:
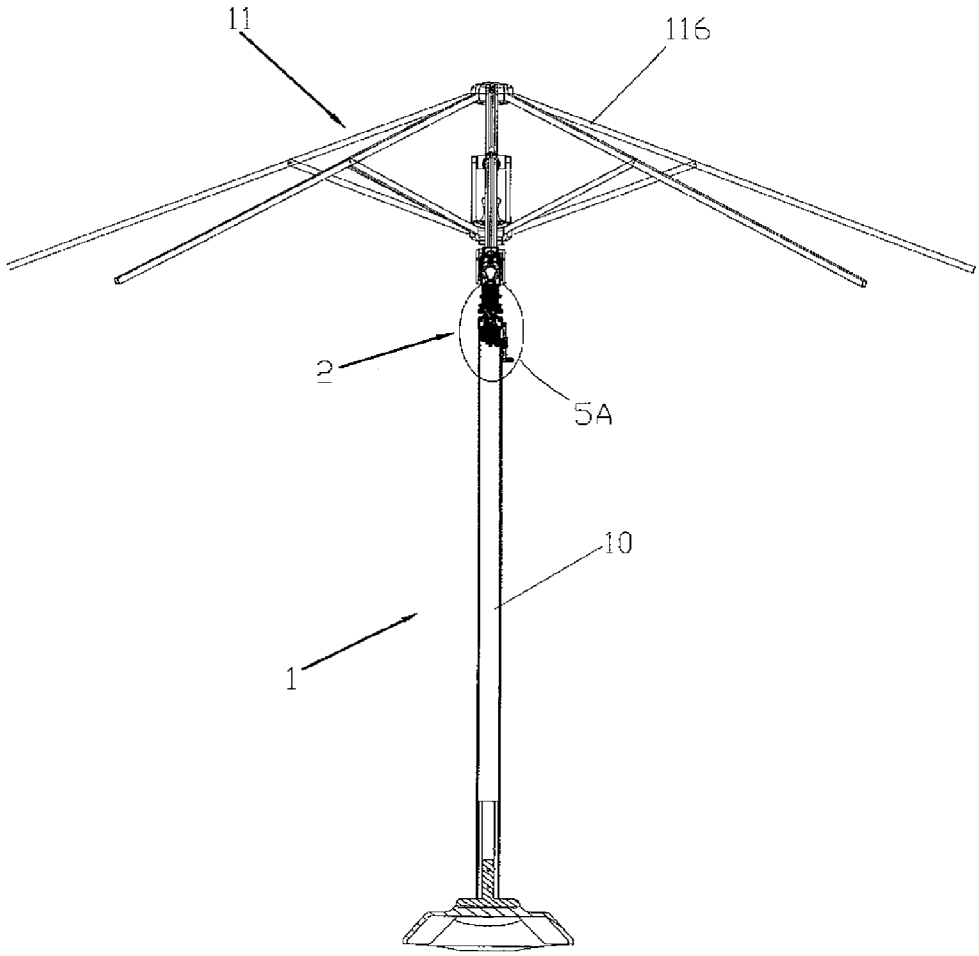
FIG. 4 is a font cross-sectional view of the umbrella as shown in FIG. 1.
Figure 5:
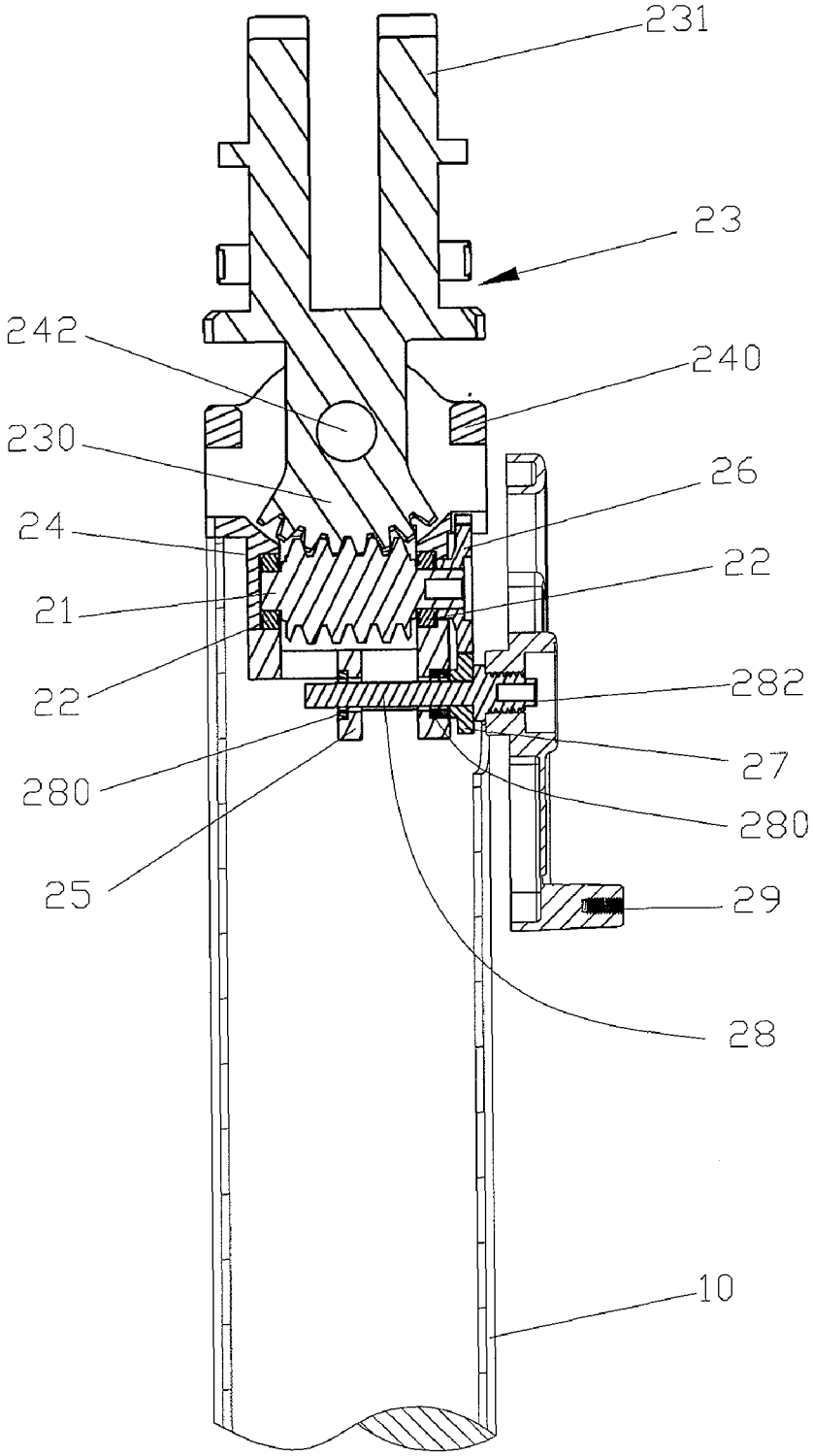
FIG. 5 is a locally enlarged view of the umbrella taken along an oblong mark "5A" as shown in FIG. 4.

Referring to the drawings and initially to FIGS. 1-5, an umbrella 1 in accordance with the preferred embodiment of the present invention comprises an upright post 10, a swing mechanism 2 pivotally mounted on the upright post 10, and a frame 11 mounted on the swing mechanism 2 to move in concert with the swing mechanism 2 and to pivot relative to the upright post 10.

The swing mechanism 2 includes a mounting seat 24 mounted on an upper end of the upright post 10, a pivot seat 23 pivotally mounted on the mounting seat 24 and having a lower end provided with a worm wheel 230, a worm 21 rotatably mounted on the mounting seat 24 and meshing with the worm wheel 230 of the pivot seat 23 to drive the pivot seat 23 to pivot relative to the mounting seat 24, a driven gear 26 secured on the worm 21 to rotate the worm 21, a propeller shaft 28 rotatably mounted on the upper end of the upright post 10, a drive gear 27 secured on the propeller shaft 28 to rotate in concert with the propeller shaft 28 and meshing with the driven gear 26 to rotate the driven gear 26, and a rocker arm 29 secured on the propeller shaft 28 to rotate the propeller shaft 28.

The swing mechanism 2 further includes a fixing seat 25 secured on a bottom of the mounting seat 24 to support the propeller shaft 28 and to limit the worm 21 and the driven gear 26, two bearings 22 mounted between the mounting seat 24 and the worm 21, and two bearings 280 mounted between the propeller shaft 28 and the fixing seat 25.

The pivot seat 23 of the swing mechanism 2 has an upper end provided with a recessed fixing portion 231 for mounting the frame 11. The mounting seat 24 of the swing mechanism 2 has an upper end provided with a socket 240, and the worm wheel 230 of the pivot seat 23 is inserted into and pivotally mounted in the socket 240 of the mounting seat 24 by a pivot shaft 242. The socket 240 of the mounting seat 24 protrudes outwardly from the upper end of the upright post 10. The mounting seat 24 of the swing mechanism 2 has a lower end inserted into the upper end of the upright post 10. The worm 21 and the driven gear 26 of the swing mechanism 2 are received in the lower end of the mounting seat 24 and located between the mounting seat 24 and the fixing seat 25. The drive gear 27 of the swing mechanism 2 has a diameter smaller than that of the driven gear 26 of the swing mechanism 2. The propeller shaft 28 of the swing mechanism 2 extends through and is rotatably mounted on the fixing seat 25. The propeller shaft 28 of the swing mechanism 2 has an end portion 282 protruding outwardly from the upper end of the upright post 10. The rocker arm 29 of the swing mechanism 2 protrudes outwardly from the upper end of the upright post 10 and is secured on the end portion 282 of the propeller shaft 28.

The frame 11 includes a mounting bracket 111 secured on and supported by the fixing portion 231 of the pivot seat 23, a support shank 110 extending through the mounting bracket 111, a skeleton 116 mounted on an upper end of the support shank 110, a grip portion 114 mounted on a lower end of the support shank 110, and an elbow link 115 having a lower end pivotally connected with the upright post 10 and an upper end pivotally connected with the grip portion 114. The upper end of the elbow link 115 of the frame 11 is provided with a pivot base 113, and the grip portion 114 of the frame 11 has a lower end provided with an universal connector 112 pivotally mounted on the pivot base 113 of the elbow link 115.

Figure 6:
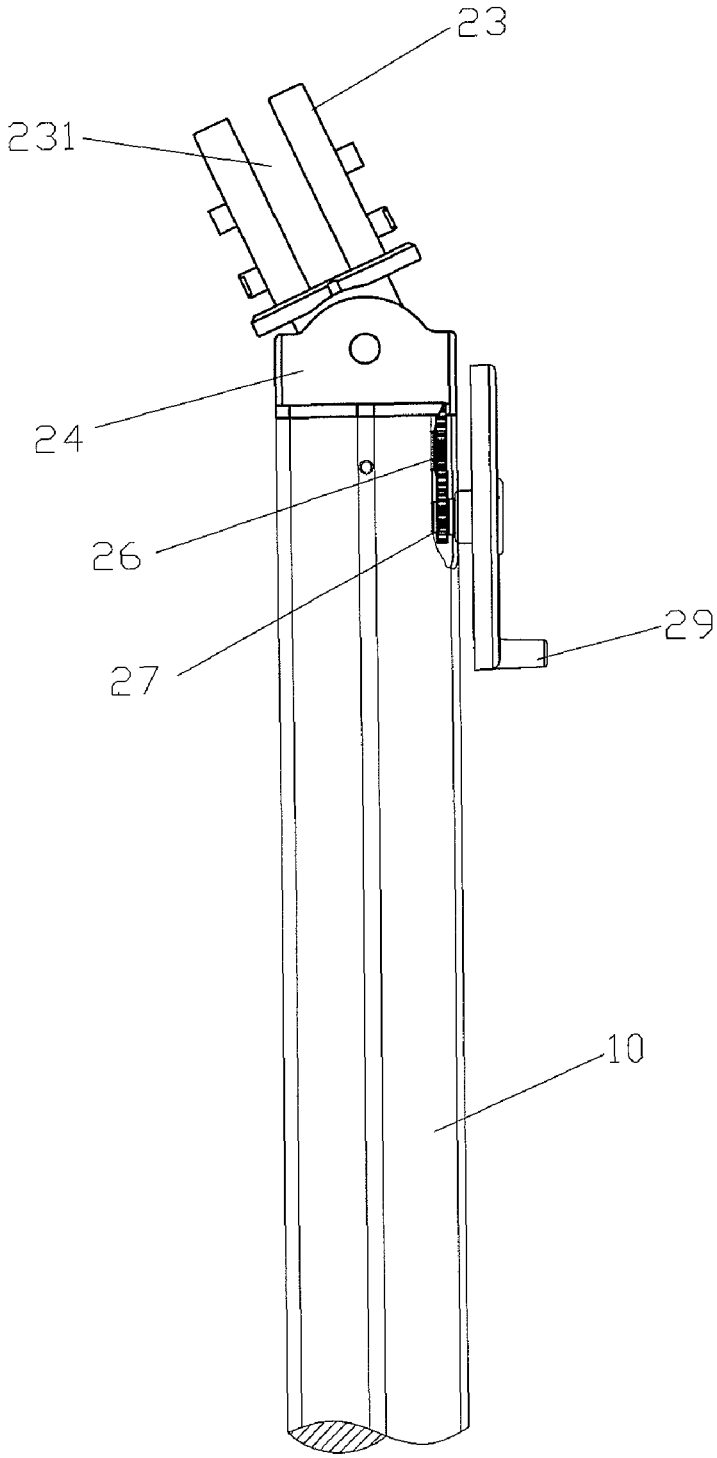
FIG. 6 is a schematic operational view of the umbrella as shown in FIG. 5.
Figure 7:
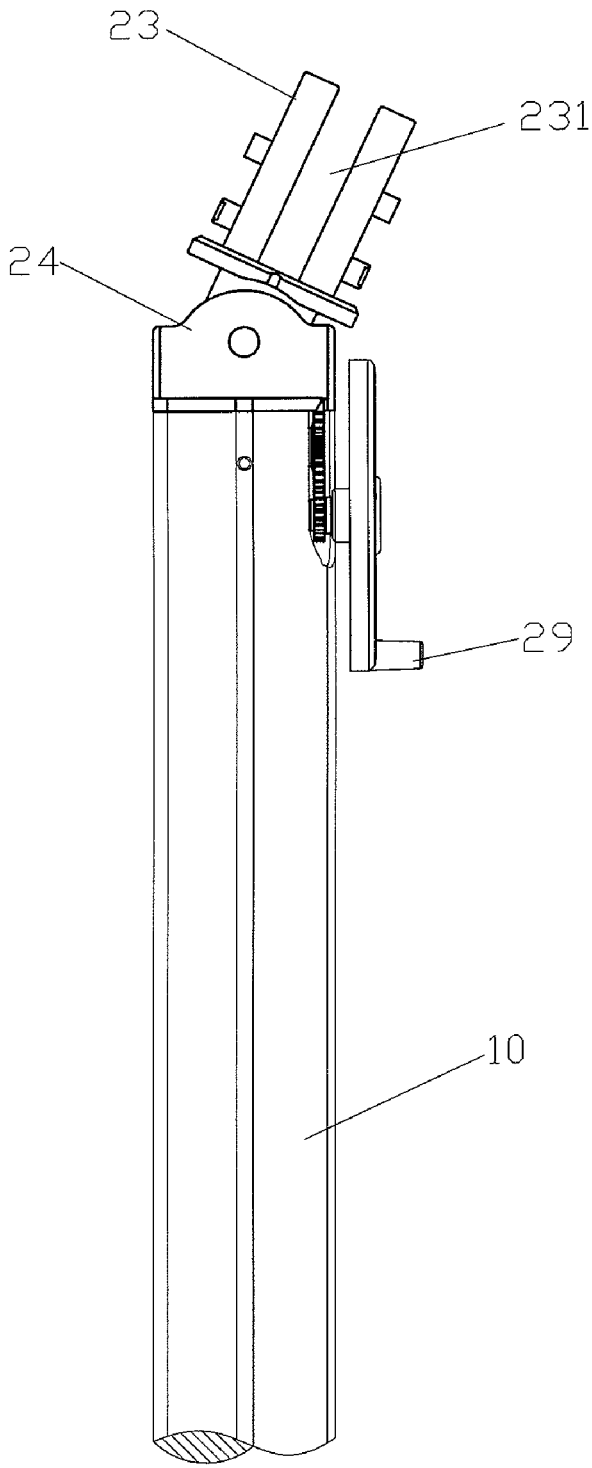
FIG. 7 is a schematic operational view of the umbrella as shown in FIG. 5.
Figure 8:
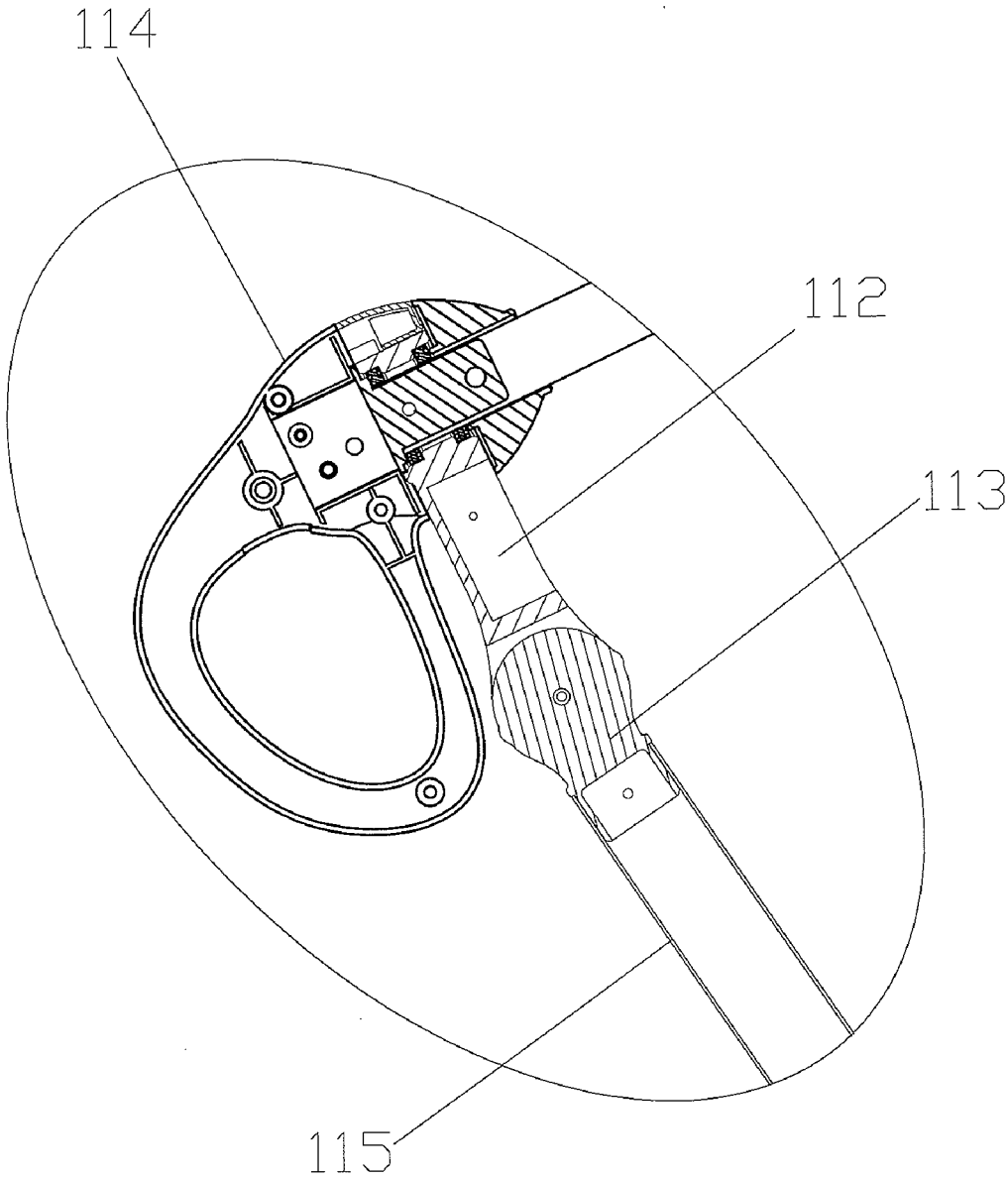
FIG. 8 is a locally enlarged view of the umbrella taken along an oblong mark "8B" as shown in FIG. 1.
Figure 9:
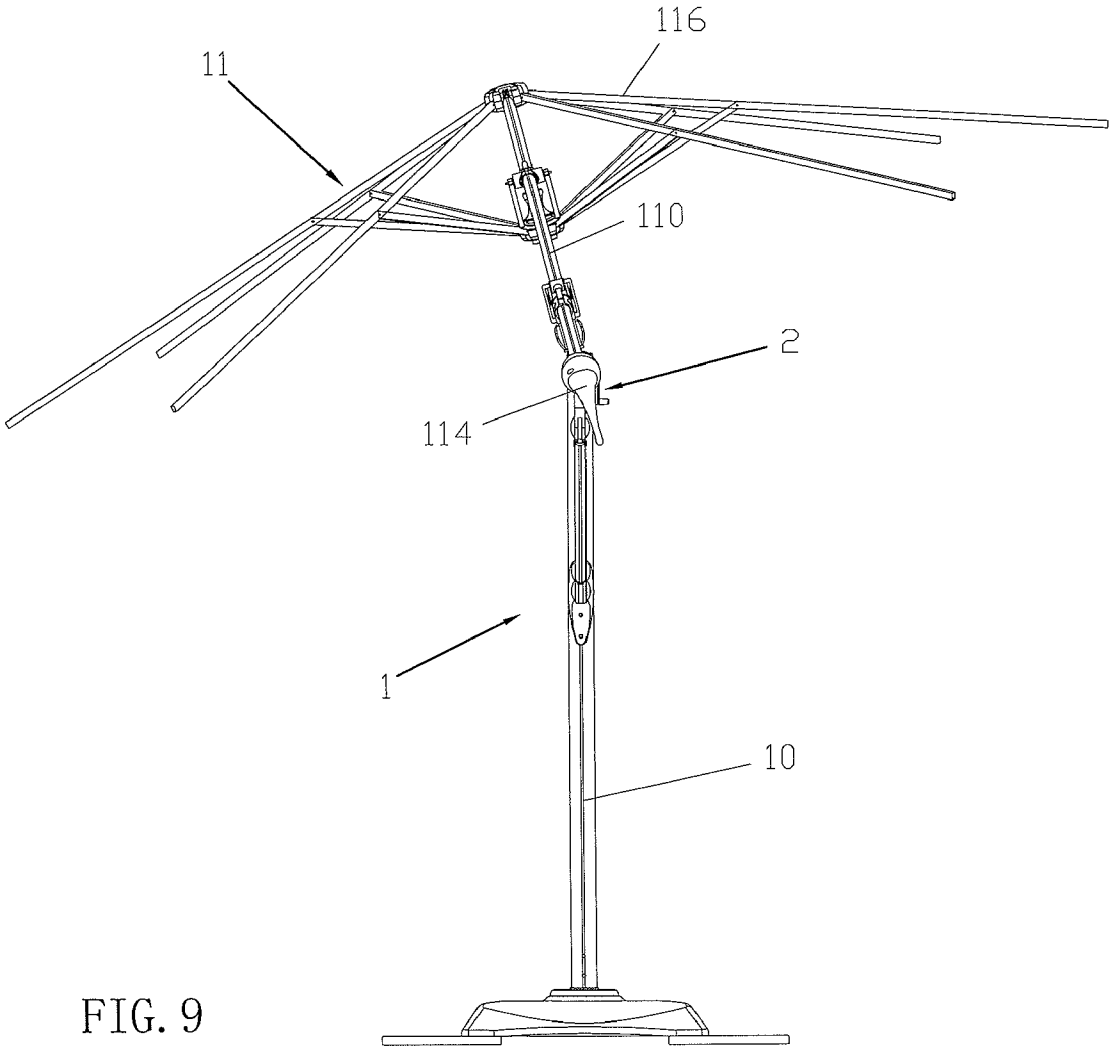
FIG. 9 is a schematic operational view of the umbrella as shown in FIG. 4.
Figure 10:
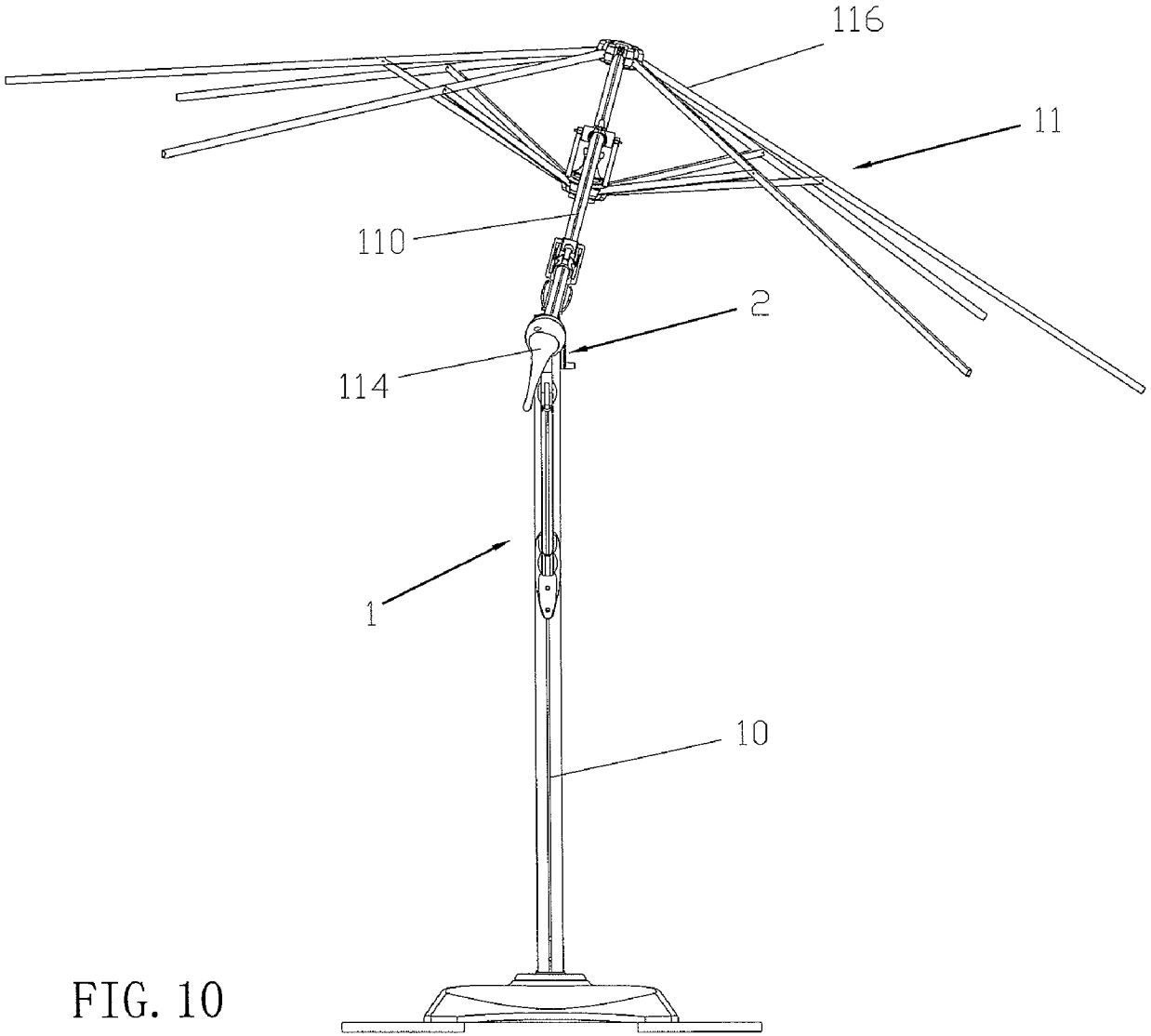
FIG. 10 is a schematic operational view of the umbrella as shown in FIG. 4.
Figure 11:
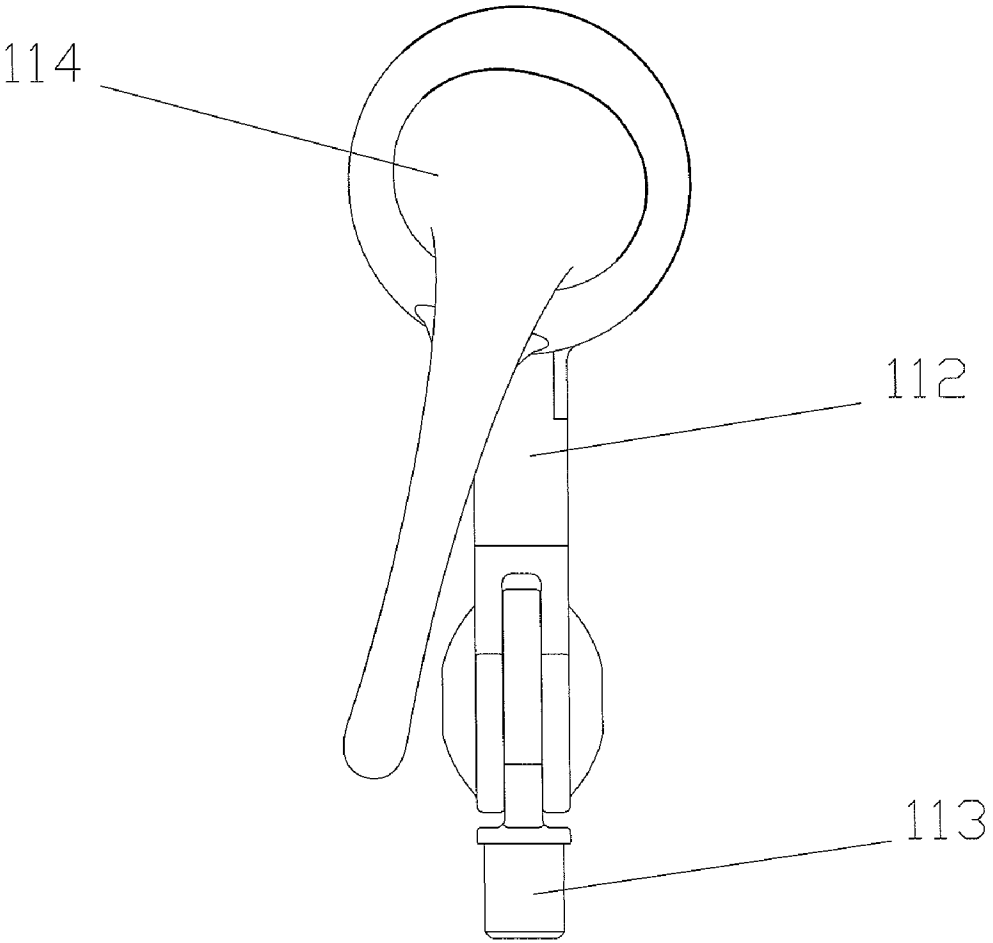
FIG. 11 is a rear operational view of the umbrella as shown in FIG. 8.
Figure 12:
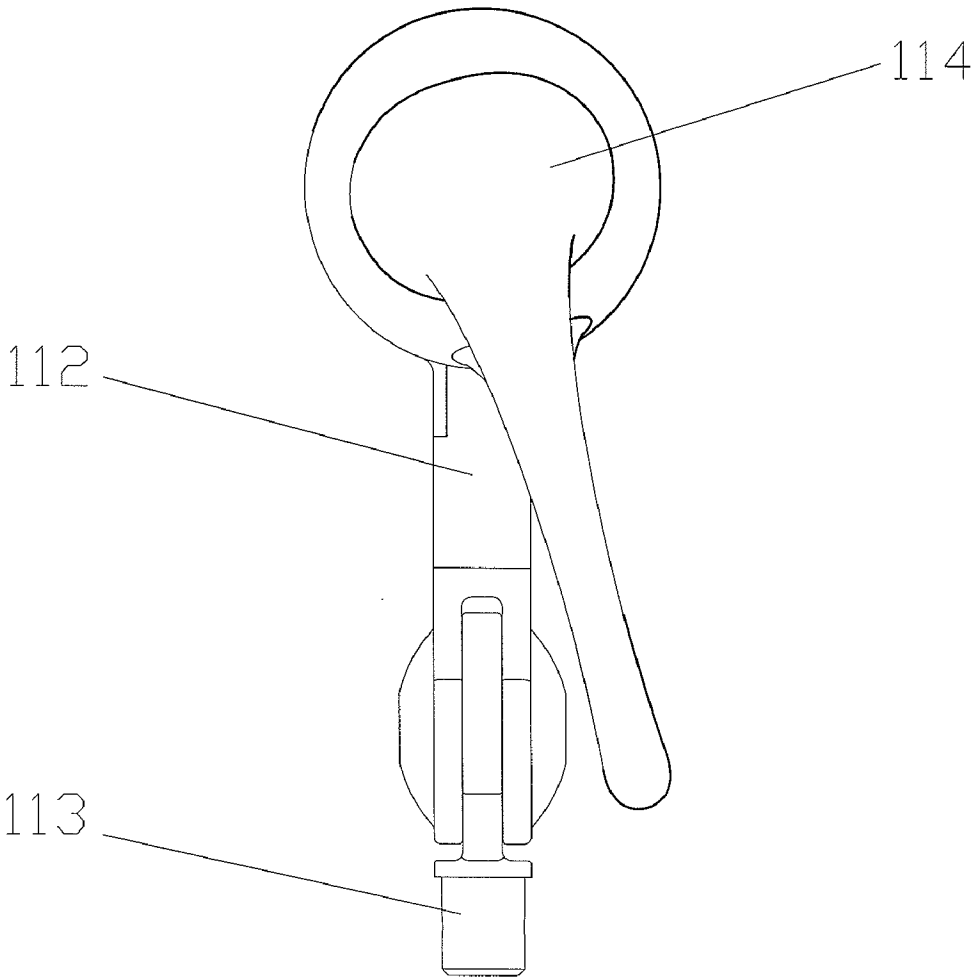
FIG. 12 is a rear operational view of the umbrella as shown in FIG. 8.

In operation, referring to FIGS. 6-12 with reference to FIGS. 1-5, when the rocker arm 29 of the swing mechanism 2 is driven by a user, the propeller shaft 28 is rotated by the rocker arm 29 to rotate the drive gear 27 which rotates the driven gear 26 which rotates the worm 21 which rotates the worm wheel 230 which moves the pivot seat 23 so that the pivot seat 23 is pivoted relative to the mounting seat 24 and is pivoted relative to the upright post 10 leftward or rightward as shown in FIGS. 6 and 7. In such a manner, the support shank 110 is moved and rolled by the pivot seat 23 to move the skeleton 116. Thus, the skeleton 116 of the frame 11 is moved and rolled relative to the upright post 10 to tilt leftward as shown in FIG. 9 or rightward as shown in FIG. 10 to adjust the inclined angle the skeleton 116 of the frame 11 so as to provide a better shading effect. At this time, the grip portion 114 of the frame 11 is also moved and rolled in concert with the support shank 110 to tilt leftward as shown in FIG. 11 or rightward as shown in FIG. 12.

Accordingly, when the swing mechanism 2 is operated, the frame 11 is rolled relative to the upright post 10 to tilt leftward or rightward to adjust the inclined angle of the skeleton 116 of the frame 11 so as to provide a better shading effect. In addition, the user only needs to drive the rocker arm 29 to change and adjust the inclined angle of the frame 11, so that the user can operate the rocker arm 29 to adjust the inclined angle of the frame 11 easily and quickly. Further, the swing mechanism 2 has a simplified construction, thereby greatly decreasing the cost of fabrication of the umbrella.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An umbrella, comprising:

an upright post;

a swing mechanism pivotally mounted on the upright post;

a frame mounted on the swing mechanism to move in concert with the swing mechanism and to pivot relative to the upright post;

wherein the swing mechanism includes:

a mounting seat mounted on an upper end of the upright post;

a pivot seat pivotally mounted on the mounting seat and having a lower end provided with a worm wheel;

a worm rotatably mounted on the mounting seat and meshing with the worm wheel of the pivot seat to drive the pivot seat to pivot relative to the mounting seat;

a driven gear secured on the worm to rotate the worm;

a propeller shaft rotatably mounted on the upper end of the upright post;

a drive gear secured on the propeller shaft to rotate in concert with the propeller shaft and meshing with the driven gear to rotate the driven gear;

a rocker arm secured on the propeller shaft to rotate the propeller shaft.

2. The umbrella of claim 1, wherein the swing mechanism further includes:

a fixing seat secured on a bottom of the mounting seat to support the propeller shaft and to limit the worm and the driven gear.

3. The umbrella of claim 2, wherein the swing mechanism further includes:

two bearings mounted between the propeller shaft and the fixing seat.

4. The umbrella of claim 2, wherein the worm and the driven gear of the swing mechanism are located between the mounting seat and the fixing seat.

5. The umbrella of claim 2, wherein the propeller shaft of the swing mechanism extends through and is rotatably mounted on the fixing seat.

6. The umbrella of claim 1, wherein the swing mechanism further includes:

two bearings mounted between the mounting seat and the worm.

7. The umbrella of claim 1, wherein the pivot seat of the swing mechanism has an upper end provided with a recessed fixing portion for mounting the frame.

8. The umbrella of claim 7, wherein the frame includes:

a mounting bracket secured on and supported by the fixing portion of the pivot seat;

a support shank extending through the mounting bracket;

a skeleton mounted on an upper end of the support shank;

a grip portion mounted on a lower end of the support shank;

an elbow link having a lower end pivotally connected with the upright post and an upper end pivotally connected with the grip portion.

9. The umbrella of claim 8, wherein the upper end of the elbow link of the frame is provided with a pivot base;

the grip portion of the frame has a lower end provided with an universal connector pivotally mounted on the pivot base of the elbow link.

10. The umbrella of claim 1, wherein the drive gear of the swing mechanism has a diameter smaller than that of the driven gear of the swing mechanism.

11. The umbrella of claim 1, wherein the mounting seat of the swing mechanism has an upper end provided with a socket;

the worm wheel of the pivot seat is inserted into and pivotally mounted in the socket of the mounting seat by a pivot shaft.

12. The umbrella of claim 11, wherein the socket of the mounting seat protrudes outwardly from the upper end of the upright post.

13. The umbrella of claim 12, wherein the mounting seat of the swing mechanism has a lower end inserted into the upper end of the upright post.

14. The umbrella of claim 13, wherein the worm and the driven gear of the swing mechanism are received in the lower end of the mounting seat.

15. The umbrella of claim 1, wherein the propeller shaft of the swing mechanism has an end portion protruding outwardly from the upper end of the upright post;

the rocker arm of the swing mechanism protrudes outwardly from the upper end of the upright post and is secured on the end portion of the propeller shaft.

* * * * *